US011766139B2

(12) United States Patent
Short et al.

(10) Patent No.: US 11,766,139 B2
(45) Date of Patent: Sep. 26, 2023

(54) GROCERY BAG LOADING RACK AND METHOD OF USING SAME

(71) Applicant: LFT Enterprises LLC, West Valley City, UT (US)

(72) Inventors: Jeffrey Brian Short, West Valley City, UT (US); Sherri Lynne Short, West Valley City, UT (US)

( * ) Notice: Subject to any disclaimer, the term of this patent is extended or adjusted under 35 U.S.C. 154(b) by 0 days.

(21) Appl. No.: 17/372,447

(22) Filed: Jul. 10, 2021

(65) Prior Publication Data

US 2022/0233001 A1 Jul. 28, 2022

Related U.S. Application Data

(60) Provisional application No. 63/199,844, filed on Jan. 28, 2021.

(51) Int. Cl.
*A47F 9/04* (2006.01)
*B65B 67/12* (2006.01)

(52) U.S. Cl.
CPC ..... *A47F 9/042* (2013.01); *B65B 67/1227* (2013.01)

(58) Field of Classification Search
CPC ..... A47F 9/042; B65B 67/1227; B65B 67/00; B65B 67/12; B65B 2067/1294
See application file for complete search history.

(56) References Cited

U.S. PATENT DOCUMENTS 4,199,122 A 4/1980 Christie
4,267,997 A 5/1981 Meier
4,332,361 A 6/1982 McClellan
D273,159 S 3/1984 Adamson et al.
4,458,867 A * 7/1984 Malik ..... B65B 67/1205 248/97
4,487,388 A * 12/1984 Provan ..... B65B 67/1227 248/97
4,579,307 A * 4/1986 Malik ..... B65B 67/1227 248/97
4,723,743 A * 2/1988 Jenkins ..... B65B 67/12 220/9.4
4,819,899 A * 4/1989 Weil ..... A47F 5/01 248/97
4,821,985 A * 4/1989 DeMatteis ..... A47F 13/085 211/12
4,840,335 A * 6/1989 Forman, Jr ..... B65B 67/1227 D34/5
4,840,336 A * 6/1989 Stroh ..... B65B 67/1227 D34/5
5,013,290 A * 5/1991 DeMatteis ..... B65D 33/001 493/201
D345,069 S 3/1994 Green
5,323,909 A * 6/1994 Piraneo ..... B65B 67/1227 383/903
5,335,788 A * 8/1994 Beasley ..... B65D 33/001 206/554

(Continued)

*Primary Examiner* — Kimberly T Wood

(74) *Attorney, Agent, or Firm* — Bretton L. Crockett; TechLaw Ventures, PLLC

(57) ABSTRACT

The invention is a grocery bag loading rack and method of using same. Embodiments of the invention are useful for supporting most any type of grocery bag in the open position so that a user can fill the grocery bag, two-handed. Embodiments of the grocery bag loading rack may be used to load plastic gusseted t-shirt, paper, or reusable cloth or fabric grocery bags.

15 Claims, 14 Drawing Sheets

(56) References Cited

U.S. PATENT DOCUMENTS

| | | | | |
|---|---|---|---|---|
| 5,921,512 | A * | 7/1999 | Torres | B65B 43/14 248/99 |
| 5,996,801 | A * | 12/1999 | Tsu | B65D 33/001 206/554 |
| 6,086,023 | A * | 7/2000 | Kerr | B65B 67/1227 248/100 |
| 9,055,829 | B1 * | 6/2015 | Marsh | B65B 67/1266 |
| 9,310,018 | B2 * | 4/2016 | Laitila | F16M 11/04 |
| 10,479,541 | B2 | 11/2019 | DeMatteis et al. | |
| 2004/0026134 | A1 * | 2/2004 | Waggoner | G01G 19/62 177/160 |
| 2006/0072856 | A1 * | 4/2006 | Su | B65D 33/001 383/8 |
| 2009/0261050 | A1 * | 10/2009 | Curren | A47F 13/085 211/85.15 |
| 2010/0096514 | A1 * | 4/2010 | Adair | B65B 67/1266 248/97 |

* cited by examiner

GROCERY BAG LOADING RACK AND METHOD OF USING SAME

CROSS-REFERENCE TO RELATED APPLICATIONS

This US non-provisional patent application claims benefit and priority to U.S. provisional patent application No. 63/199,844 filed on Jan. 28, 2021, titled "BAG RACK FOR REUSABLE GROCERY BAGS AND STANDARD T-SHIRT BAGS", the contents of which are incorporated by reference as if fully set forth herein and for all purposes.

BACKGROUND OF THE INVENTION

Field of the Invention

The present invention relates generally to systems and methods for loading grocery bags. More particularly, this invention relates to a grocery bag loading rack and method of using same that is useful for dispensing, setting up, packing and filling all types of grocery bags, for example and not by way of limitation, plastic gusseted t-shirt, paper, or reusable cloth bags.

Description of Related Art

Grocery store customers typically have a choice in how to carry their groceries after purchase. They can simply hand-carry the item(s) purchased or simply replace groceries back into a grocery cart for loading into the customer's vehicle. More frequently a grocery bag is provided by the grocery store if the customer needs one. Grocers may offer to bag the purchased groceries in paper bags or plastic gusseted "t-shirt" bags free of charge. Grocers may also offer for sale and use by their customers reusable grocery bags that are made of a number of materials ranging from cloth to nylon webbing. Such reusable grocery bags are popular with customers as they reduce waste typically produced by single-use plastic and paper bags.

The variety of grocery bags makes the efficient packing and filling of same by grocery store baggers or even the customers themselves problematic because the bags do not hold themselves open during filling. It would be useful to have a system and method that allows any variety of grocery bag to be held open for rapid two-handed filling by whoever is bagging purchased groceries.

Accordingly, there exists a need in the art for an improved grocery bag loading rack and method of using same.

SUMMARY OF THE INVENTION

Embodiments of the invention include a grocery bag loading rack. The rack may include a cuboid-shaped frame having a bottom, right, left and rear sides. The frame may be configured for supporting a grocery bag in open position to form a loading void, within the grocery bag that is also within the frame. According to one particular embodiment, the frame may be open at top and front sides. According to this embodiment, the rear side may further include a left rear pillar defining a boundary between the left and rear sides, and a right rear pillar defining a boundary between the right and rear sides. According to this embodiment, the left side may further include a left bottom bar extending from the left rear pillar that defines a boundary between the left and bottom sides of the frame. According to this embodiment, the right side mirrors the left side and further includes a right bottom bar extending from the right rear pillar that defines a boundary between the right and bottom sides. According to this embodiment, the bottom side may further include a left front bottom hook extending from left bottom bar in a direction toward the right side. According to this embodiment, the bottom side may further include a right front bottom hook extending from the right bottom bar in a direction toward the left side. According to this embodiment, the bottom side may further include a left rear bottom hook extending from the left rear pillar down toward a plane passing through the bottom side and in a direction toward the front side. According to this embodiment, the bottom side may further include a right rear bottom hook extending from the right rear pillar down toward the plane through the bottom side and in a direction toward the front side.

Additional, embodiments, features and advantages of the invention will be apparent from the detailed description which follows, taken in conjunction with the accompanying drawings, which together illustrate, by way of example, features of embodiments of the present invention.

BRIEF DESCRIPTION OF THE DRAWINGS

The following drawings illustrate exemplary embodiments for carrying out the invention. Like reference numerals refer to like parts in different views or embodiments of the present invention in the drawings.

The following drawings illustrate exemplary embodiments for carrying out the invention. Like reference numerals refer to like parts in different views or embodiments of the present invention in the drawings.

FIG. 1B is a front view of the embodiment of a grocery bag loading rack shown in FIG. 1A, according to the present invention.

DETAILED DESCRIPTION

The invention is a grocery bag loading rack useful for bagging groceries at the point of sale, or grocery store.

Embodiments of the grocery bag loading rack may be used by grocery store baggers, checkers and customers at the check-out stand. Embodiments of the grocery bag loading rack have specific structural features allowing for use with the most common types of bags used to carry groceries from the grocery store to their final destination. Such grocery bags may be, for example and not by way of limitation, plastic gusseted "t-shirt" bags, paper bags and reusable grocery bags. A particularly useful aspect of the various embodiments of the grocery bag loading rack is the ability to hold open a grocery bag to allow for two handed loading/filling of the grocery bag. This feature saves time and expedites the transition through the check-out process during grocery shopping. With this general background and feature description in mind, a particular embodiment of a grocery bag loading rack will now be described with reference to the drawings.

Figure 1A:
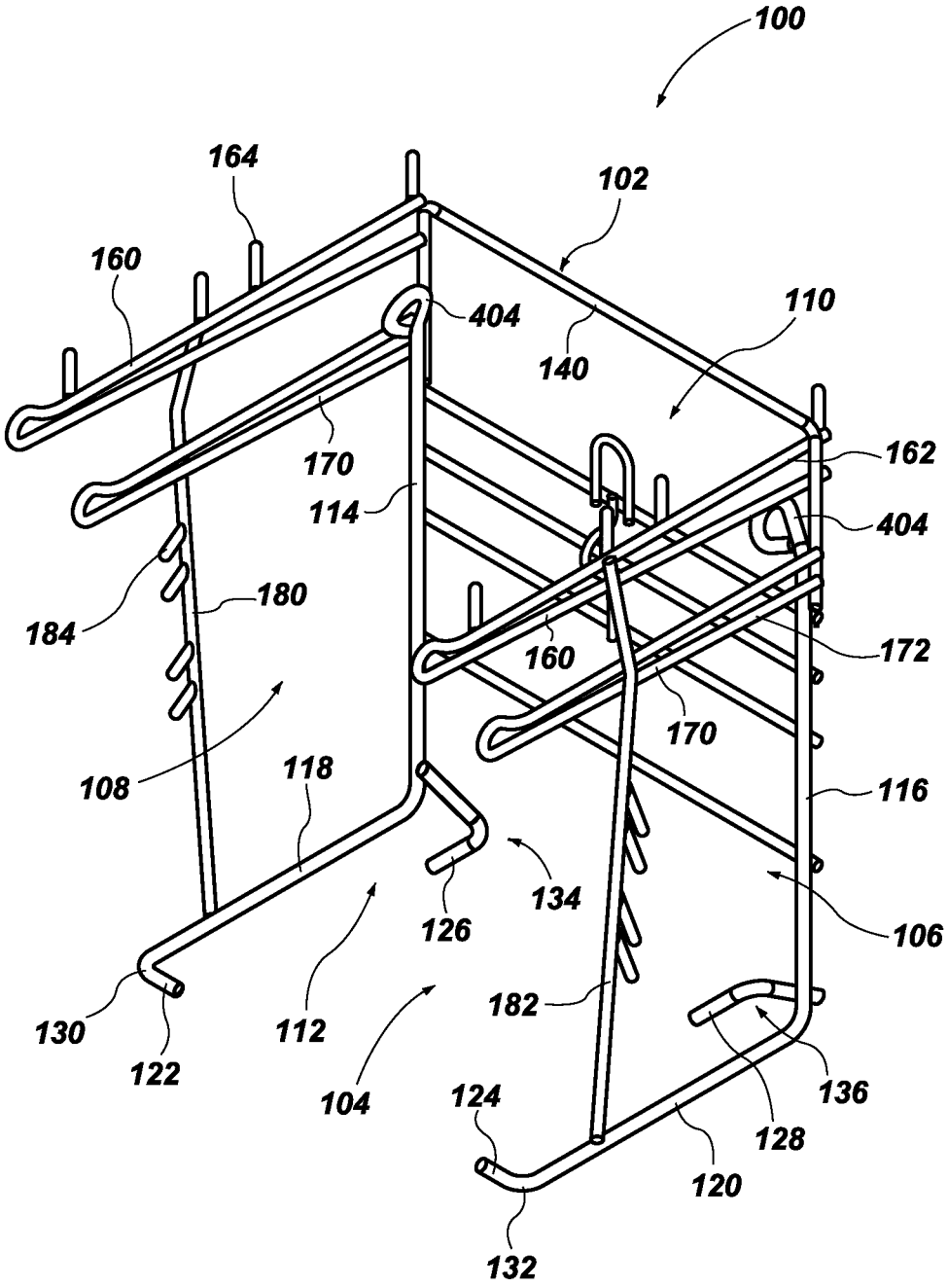
FIGS. 1A and 1B are perspective and front views, respectively, of an embodiment of a grocery bag loading rack according to the present invention.
Figure 1B:
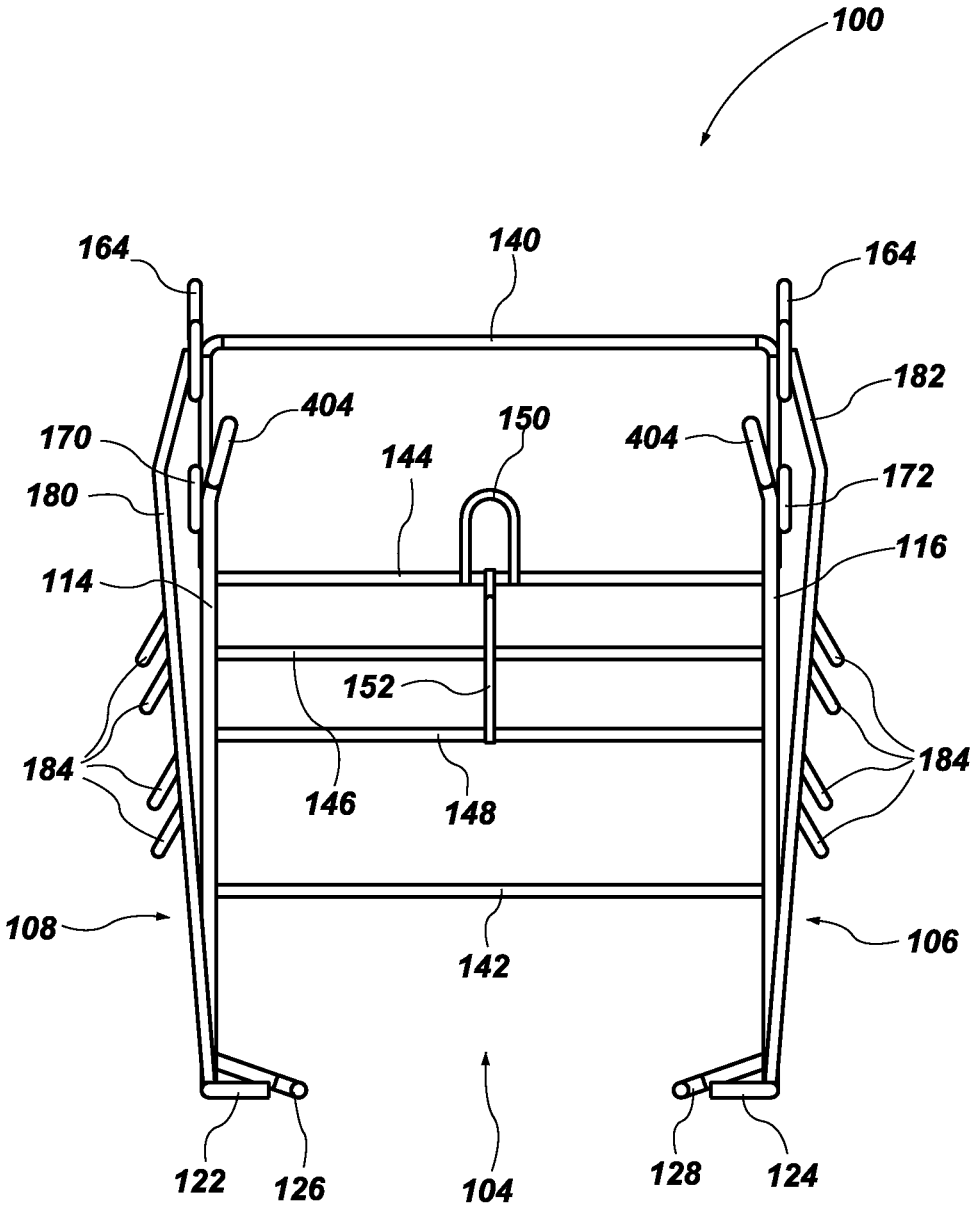

FIGS. 1A and 1B are perspective and front views, respectively, of a grocery bag loading rack 100 according to an embodiment of the present invention. Embodiments of a grocery bag loading rack 100 may be of a generally cuboid-shaped frame constructed from any suitable material, for example and not by way of limitation, metal, carbon fiber, plastic, etc. The only limitation in the material type is suitable structural rigidity for repeatedly supporting a full bag of groceries inside a grocery bag on a horizontal surface during daily use at a grocery store, for example. According to the illustrated embodiment, grocery bag loading rack 100 may be constructed from sections of metal rod bent and adhered to each other by spot welding. It will be understood that other embodiments of grocery bag loading rack 100 may be constructed from sections of metal rod bent and adhered to each other by other means such as welding, brazing, etc., known to those of ordinary skill in the art. I will also be understood that the grocery bag loading rack 100 frame 102 may be configured with coatings for durability and anti-corrosion. Furthermore, it will be understood that any generally cuboid-shaped box-like structure having four sides generally closed for supporting a grocery bag in the open position and two adjacent sides (top and front) generally open and configured for top loading and removal of the filled bag out the front side fall within the general spirit and scope of the present invention.

Figure 3A:
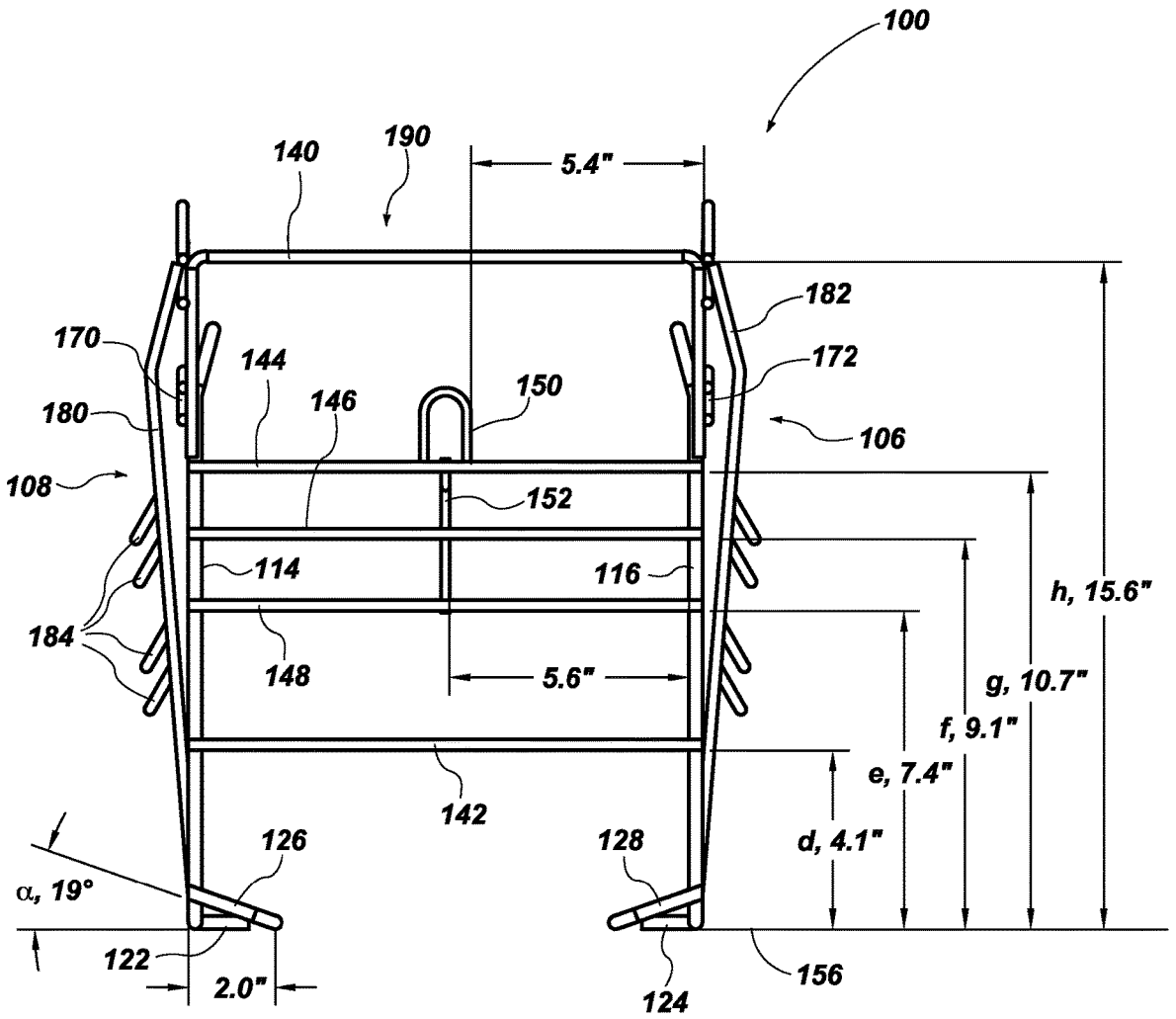
FIG. 3A is a rear view of an embodiment of a grocery bag loading rack, according to the present invention.
Figure 4A:
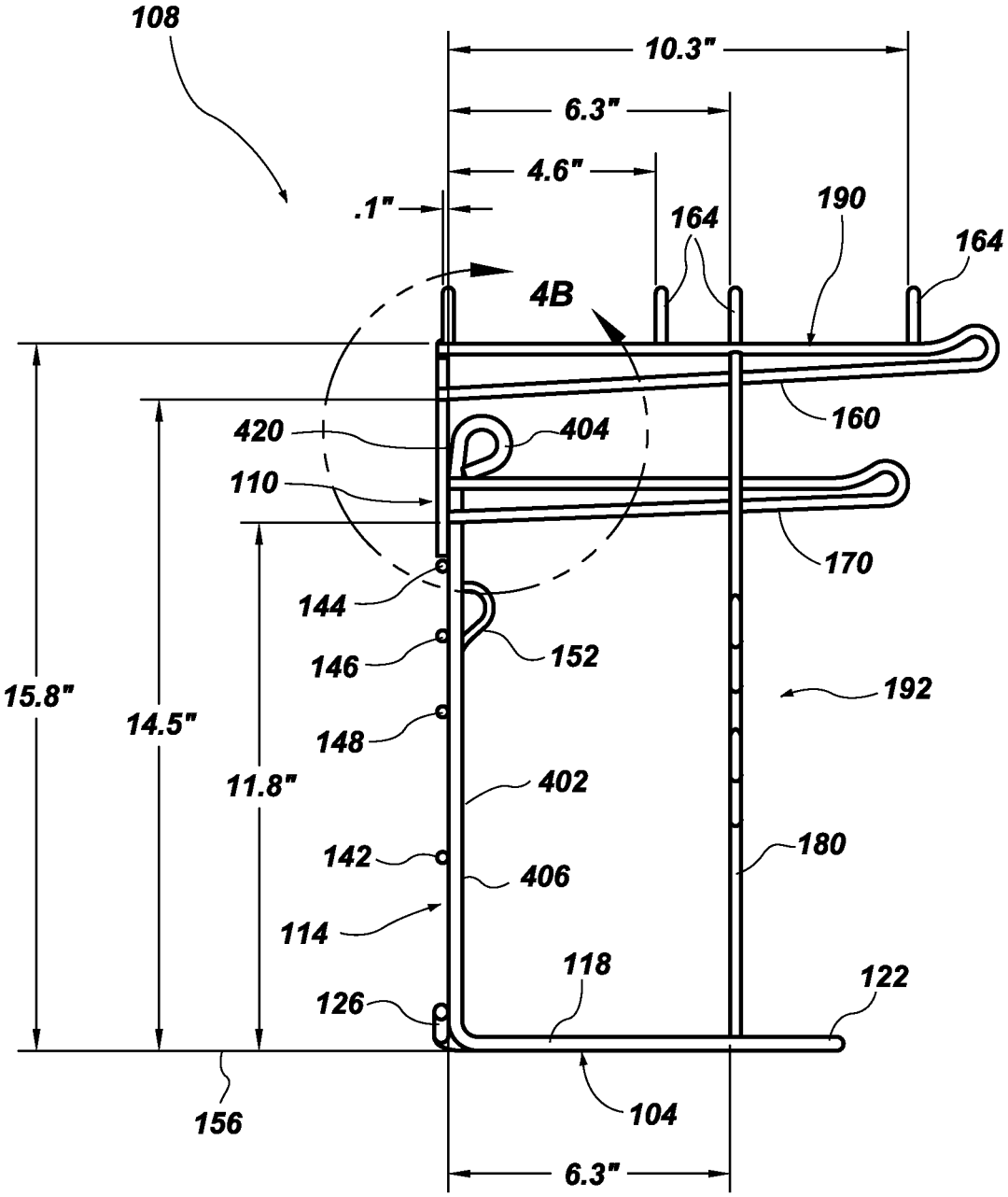
FIG. 4A is a left side view an internal left side of an embodiment of a grocery bag loading rack, according to the present invention.
Figure 4B:
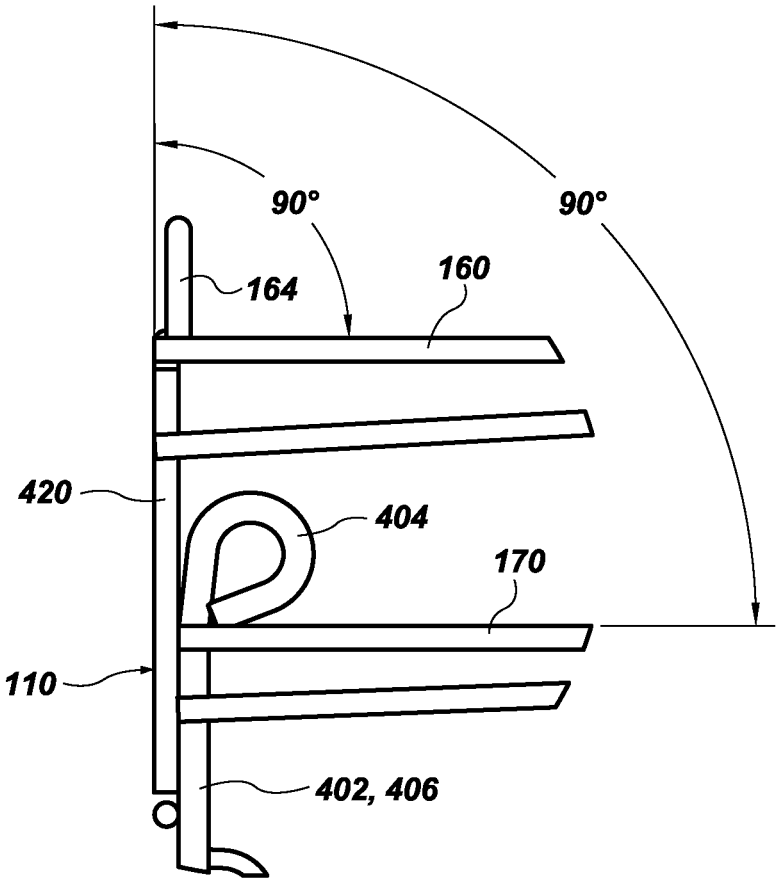
FIG. 4B is a detailed view of an embodiment of an upper left rear pillar of the grocery bag loading rack as indicated in FIG. 4A of the present invention.

The illustrated embodiment of a grocery bag loading rack 100 and frame 102 may generally be configured as a with a bottom side 104, left 108 and right 106 sides that are mirror-images (symmetrical) to each other and a rear side 110 (FIGS. 1A, 4A and 4B). Top 190 and front 192 sides (both shown best in FIG. 3A) of the generally cuboid-shaped frame 102 are open for top loading and removal of the filled bag out the front side 192, as noted above. The intersection of a plane passing through the left side 108 and another plane passing through the rear side 110 (FIGS. 1A, 4A and 4B) of the rack 100 forms a left rear pillar 114 of the rack 100. Conversely, the intersection of a plane passing through the right side 106 and the plane passing through the rear side 110 of the rack 100 forms a right rear pillar 116 of the rack 100. As shown in FIGS. 1A and 1B, an upper support bar 140, connected to the left 114 and right 116 rear pillars, generally defines a boundary between the rear side 110 and the open top side with the exception of plurality of vertical elements (described in further detail below) located about the top edges of the rack 100. A loading void 112 may be disposed inside the bottom 104, right 106, left 108 and rear 110 sides of the rack 100 and frame 102. It is within this loading void 112 that a grocery bag (not shown) may be supported in an open position for filling/loading by a user.

The embodiment of a bottom side 104 of frame 102 is generally open and configured to rest on a horizontal surface (not shown). One such a horizontal surface may be located at the end of a cashier-operated checkout stand in a grocery store at a location such that with the rack 100 installed, the open top is generally flush with the top surface of a collection surface where groceries collect after being scanned for purchase, but prior to loading into grocery bags. Another such surface may be the bottom surface of a carousel having multiple racks 100 installed adjacent to a self-checkout stand. It will be understood that embodiments of the racks disclosed herein may be located anywhere that loading of grocery bags or any suitable bags having handles may be used, not necessarily for groceries, although that is the primary intended use of the invention.

The embodiment of a bottom side 104 of frame 102 may be bounded on the left side by a left bottom bar 118 found at the intersection of the plane passing through the left side 108 and a plane passing through the bottom side 104. Similarly, the embodiment of a bottom side 104 of frame 102 may be bounded on the right side by a right bottom bar 120 found at the intersection of the plane passing through the right side 106 and the plane passing through the bottom side 104.

The embodiment of a bottom side 104 may further include a left front bottom hook 122 extending from the left front bottom corner of frame 100. The left front bottom hook 122 may extend perpendicularly away from the left bottom bar 118 in a direction toward the right side 106 and within the plane passing through the bottom side 104, but only a short distance, d, thereby forming a left front foot 130 of rack 100. As the right side 106 is symmetrical to the left side 108, a right front bottom hook 124 may extend perpendicularly away from the right bottom bar 120 in a direction toward the left side 108 also within the plane passing through the bottom side 104, but only a short distance, d, thereby forming a right front foot 132 of rack 100.

The illustrated embodiment of a rack 100 may further include left rear 134 and right rear 136 feet. The left rear foot 134 may be formed by a left rear bottom hook 126 extending initially away from the left rear pillar 114 in a direction toward the right side 106 and then bending at the plane of the bottom side 104 and extending in a direction toward the open front of rack 100 within the plane of the bottom side 104. Again, in view of the left to right symmetry of the rack 100, right rear foot 136 may be formed by a right rear bottom hook 128 extending initially away from the right rear pillar 116 in a direction toward the left side 108 and then bending at the plane of the bottom side 104 and extending in a direction toward the open front of rack 100 within the plane of the bottom side 104. The feet 130, 132, 134 and 136 and their respective hooks 122, 124, 126 and 128 are configured to mate with mounting holes in an optional base 200, not shown, but described below with reference to FIGS. 2A-2C.

The illustrated embodiment of a rack 100 may further include left 160 and right 162 upper arms located near the top of rack 100. It will be understood that the left 160 and right upper 162 arms are generally configured to support reusable grocery bags (not shown). It is well understood by most anyone, and certainly those of ordinary skill in the art, that most reusable grocery bags are configured to fold flat for storage and open up into a cuboid shape to surround a void, with looped handles, or straps, at a top opening used for loading and unloading groceries and other items to be carried within the void, generally with the looped handles, or straps. Embodiments of the left 160 and right 162 upper arms are secured to respective left rear 114 and right rear 116 pillars at the rear side 110 of rack 100 and to respective left forward 180 and right forward 182 supports on the left 108 and right 106 sides of rack 100.

When using reusable grocery bags with the embodiment of rack 100, it is useful to be able to support each bag in an open position within the rack 100. Accordingly, the left 160 and right 162 upper arms are configured with a plurality of vertical prongs 164 disposed at intervals across the top of the left 160 and right 162 upper arms for holding the looped handles, or straps of the reusable grocery bag. A user simply stretches the looped straps around as many vertical prongs 164 as necessary to lift and stretch a given side of the reusable grocery bag apart from its opposite side to open the bag. Depending on the length of the looped handles, or straps of the reusable grocery bag, one or two of such vertical prongs 164 may be sufficient for supporting each side of the given reusable grocery bag. However, not all reusable grocery bags are configured with identically sized looped handles, or straps. Some straps are longer than others.

Accordingly, rack 100 is further configured with downward angled prongs 184 located on each of the left 180 and right 182 forward supports. These downward angled prongs 184 are dispersed at intervals along a central portion of each left 180 and right 182 forward support and configured to receive the furthest end of the looped handle if necessary. Furthermore, each downward angled prong 184 is configured to receive a looped handle or strap of the reusable grocery bag, when the vertical prongs 164 are not enough to support the handle alone, and thereby hold the bag in the open position in combination with vertical prongs 164. In this way, virtually any length of looped handle, or straps, of a reusable grocery bag may be secured in the open position of the disclosed embodiment of rack 100.

The illustrated embodiment of a rack 100 may further include left 170 and right 172 lower arms located below respective left 160 and right 162 upper arms of rack 100. It will further be understood that the left 170 and right 172 lower arms are configured to receive left and right openings (not shown) in the packet of disposable gusseted plastic bags (also not shown) when the packet is initially installed and to support individual plastic bags as they are pulled open for use and filled. Thus, the lower arms 170 and 172 are specifically configured for use with a packet of disposable gusseted plastic bags. However, there may be versions of reusable bags that can be sufficiently supported on the left 170 and right 172 lower arms of rack 100.

Figure 2A:
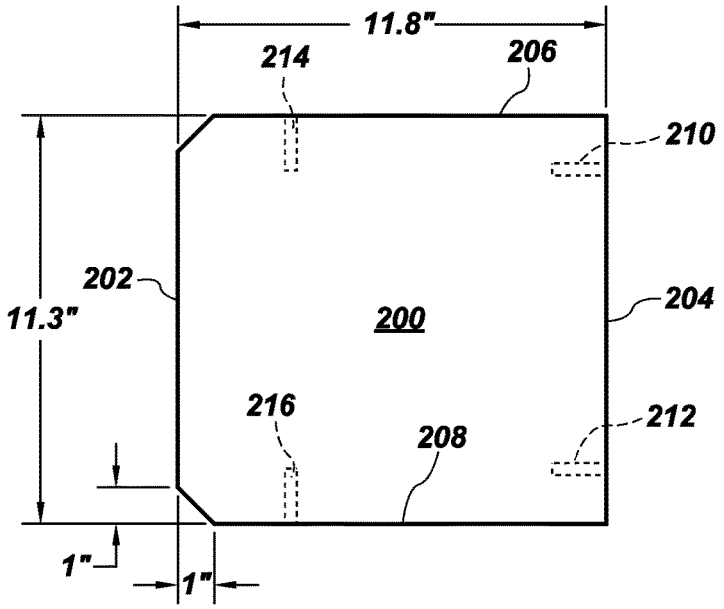
FIGS. 2A, 2B and 2C are plan, front edge and right edge views of an embodiment of a base for a grocery bag loading rack, according to the present invention.
Figure 2B:
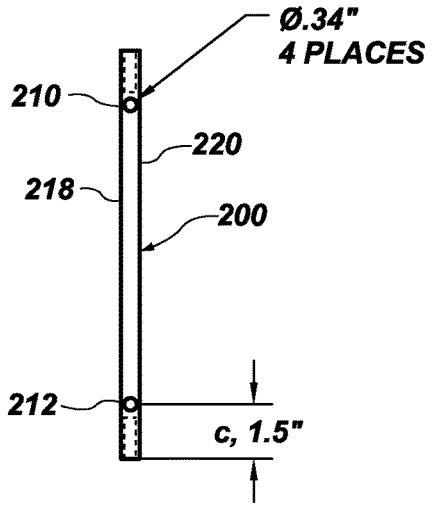
Figure 2C:
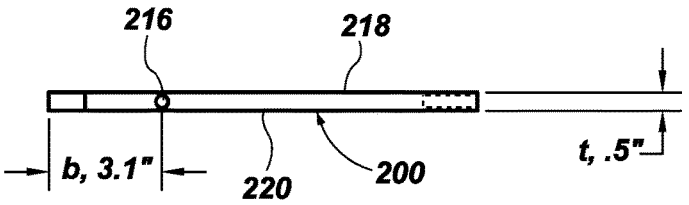

FIGS. 2A, 2B and 2C are plan, front edge and right edge views of an embodiment of an optional base 200 for grocery bag loading rack 100 according to the present invention. From the plan view shown in FIG. 2A, the embodiment of a base 200 may be generally rectangular in shape and may include front, 202, rear 204, left 206 and right 208 edges, with symmetry from left to right. In the embodiment of base 200, rear edge 204 may further include a left rear mounting hole 210, disposed closer to the left edge 206 than the right edge 208, and with axis parallel to the left 206 and right 208 edges. Rear edge 204 may further include a right rear mounting hole 212, disposed closer to the right edge 208 than the left edge 206, and also with axis parallel to the left 206 and right 208 edges. Mounting holes 210 and 212 may be configured to receive left rear bottom hook 126 and right rear bottom hook 128, respectively, to form a closed bottom to the frame 102 of rack 100. As best shown in FIG. 2B, the right rear mounting hole 212 may be disposed a distance, c, from the right edge 208 of base 200. Similarly, because of symmetry, left rear mounting hole 210 may be disposed the same distance, c, from the left edge 206 of the base 200. According to a particular embodiment of base 200, distance, c, may be about 1.5". However, it will be understood that in other embodiments, not illustrated, distance, c, may be some other distance than 1.5".

Referring again to FIG. 2A, the left edge 206 of base 200 may be configured with a left mounting hole 214 configured to mate with left front bottom hook 122 (FIG. 1A). According to one embodiment, left mounting hole 214 extends perpendicularly from the left edge 206 toward the right edge 208, but not all the way to the right edge 208. As best shown in FIG. 2C, the axis of left mounting hole 214 may be located a distance, b, from the front edge 202. Conversely, because of symmetry, the right edge 208 of base 200 may be configured with a right mounting hole 216 configured to mate with right front bottom hook 124 (FIG. 1A). According to one embodiment, left mounting hole 214 may extend perpendicularly from the right edge 208 toward the left edge 206, but not all the way to the left edge 206. As best shown in FIG. 2C, the axis of right mounting hole 216 may also be located a distance, b, from the front edge 202 and is coaxial with axis of left mounting hole 214. According to one embodiment, distance, b, may be about 3.1". Of course, it will be understood that distance, b, may be any suitable distance for receiving left front 122 and right front 124 bottom hooks, according to the present invention.

FIGS. 2B and 2C illustrate that base 200 may have a thickness, t. According to the illustrated embodiment, thickness, t, may be about 0.5". However, it will be understood that any other suitable thickness of base 200 may be employed according to other embodiments of the present invention. The mounting holes 210, 212, 214 and 216 may be bored or formed between a top surface 218 and a bottom surface 220 of the base 200. The diameter of mounting holes 210, 212, 214 and 216 are generally configured to be slightly larger than the diameter of their respective hooks 122, 124, 126 and 128, such that the base may be securely mounted to rack 100, with a friction fit, but not so tightly that it is difficult to remove the hooks 122, 124, 126 and 128 from respective holes 210, 212, 214 and 216. According to the illustrated embodiment of base 200, corners closest to the left 214 and right 216 mounting holes may be cut-off at 45° angles relative to their respective sides. However, other embodiments contemplate rounded corners and chamfering of sharp edges. The base may be formed of any suitable material, for example and not by way of limitation, wood, metal, plastic or any other material that has mounting holes 210, 212, 214 and 216 for receiving hooks 122, 124, 126 and 128 from the frame 102 to provide a stable base for the rack 100.

Figure 3B:
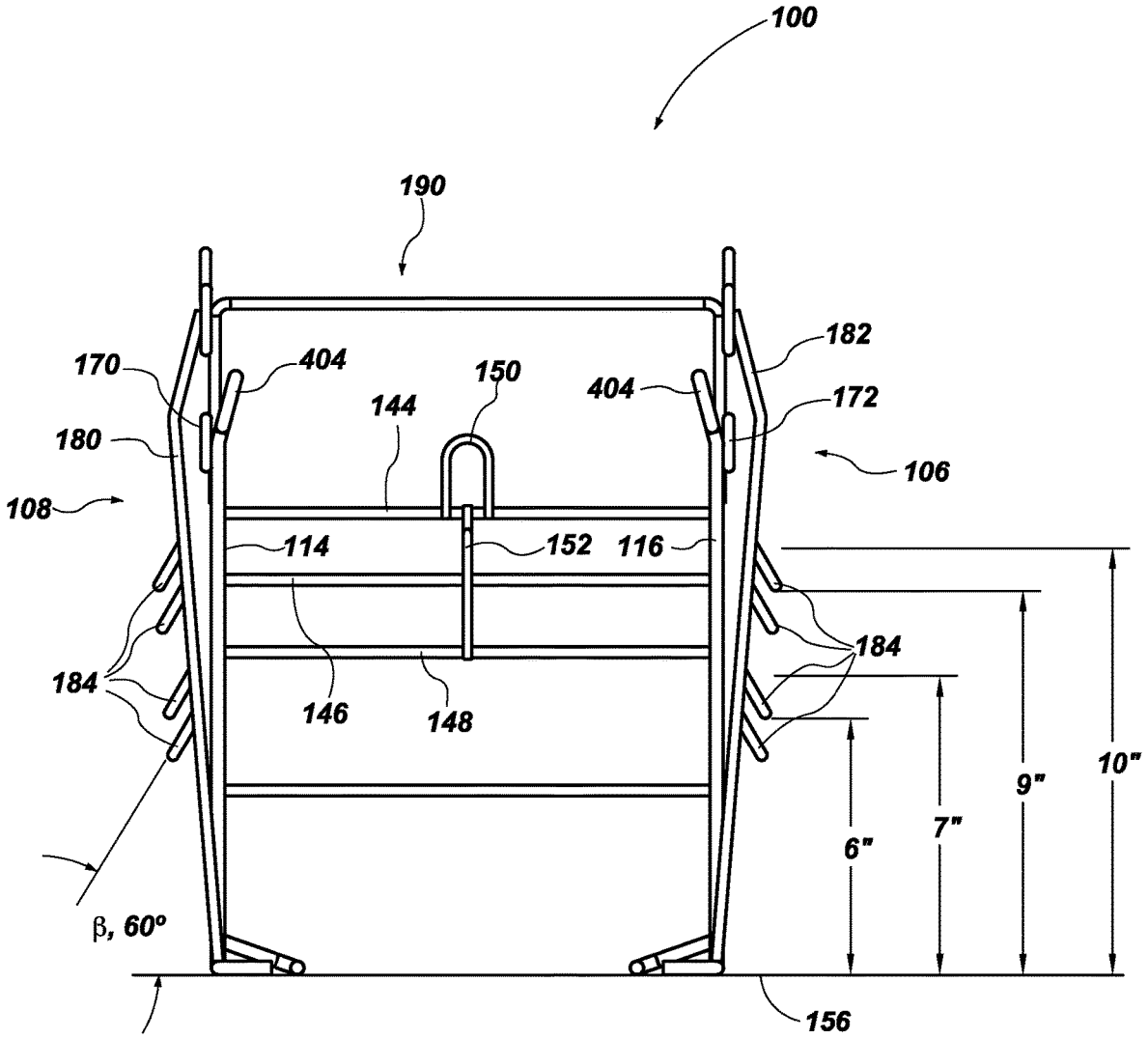
FIG. 3B is a front view of an embodiment of a grocery bag loading rack, according to the present invention.

FIGS. 3A and 3B are additional rear and front views, respectively, of an embodiment of a grocery bag loading rack 100 according to the present invention. More particularly, FIGS. 3A and 3B illustrates various dimensions and feature angles relating to a particular embodiment of a grocery bag loading rack 100. It will be understood that the dimensions illustrated are only exemplary and not limiting of the present invention. FIG. 3A is particularly useful for illustrating relative dimensions of features located on the rear side 110 of rack 100. Whereas, FIG. 3B is particularly useful for illustrating relative dimensions and angles of features shown on the left 108 and right 106 sides of rack 100.

As shown in FIGS. 3A and 3B, the rear side 110 of rack 100 includes an upper support bar 140, a lower support bar 142, a first intermediate support bar 144, a second intermediate support bard 146 and a third intermediate support bar 148, all of which are parallel to one another and are connected at opposite ends to left 114 and right 116 rear pillars to support rack 100. The three intermediate support bars, 144, 146 and 148 (also referenced and shown in FIG. 1B) are used to support additional features of the rack 100, as described below. Left 170 and right 172 lower arms are also visible and not touching respective left 180 and right 182 forward supports.

As shown in FIGS. 3A and 3B, an embodiment of an inverted U-shaped standard bag hook 150 is disposed vertically on first intermediate support bar 144 at a position centrally along the length of first intermediate support bar 144. The standard bag hook 150 is used to hang a standard packet or bundle of disposable plastic gusseted t-shirt grocery bags (not shown) for easy dispensing and use from within the rack 100. FIGS. 3A and 3B further illustrate an embodiment of a spine loop 152 connected centrally to first 144, second 146 and third 148 intermediate support bars. Spine loop 152 includes a bend, or loop portion 154 (not visible in the views of FIGS. 3A and 3B) that extends toward the open front of rack 100. The spine loop portion 154 of spine loop 152 pushes the neck of the standard bundle of disposable plastic gusseted t-shirt grocery bags forward, which the user (operator, bagger, or checker) pushes against with fingers to create the friction needed to open up a single bag with a downward sliding motion. Without such a spine loop portion 154, there is less stress across the entire upper portion of the bundle of bags and, in particular, an individual plastic bag. So, instead of being able to apply pressure to generate that friction, the user would be just pushing the bag back and not opening the bag for use.

Referring now to FIG. 3A, a generic embodiment, lower support bar 142 may be located a distance, d, from a horizontal surface 156 upon which the bottom side 104 of rack 100 rests. Distance, d, may be about 4.2" according to a specific embodiment of rack 100. According to another generic embodiment, third intermediate support bar 148 may be located a distance, e, from the horizontal surface 156. Distance, e, may be about 7.4" according to one embodiment of rack 100. According to yet another generic embodiment, second intermediate support bar 146 may be located a distance, f, from the horizontal surface 156. Distance, f, may be about 9.1" according to one embodiment of rack 100. According to still another generic embodiment, first intermediate support bar 144 may be located a distance, g, from the horizontal surface 156. Distance, g, may be about 10.7" according to one embodiment of rack 100. According to still yet another generic embodiment, upper support bar 140 may be located a distance, h, from the horizontal surface 156. Distance, h, may be about 15.6" according to one embodiment of rack 100. According to one embodiment, a portion of the left rear foot 134 extending from left rear pillar 114 may extend at an angle, $\alpha$, relative to horizontal surface 156. Angle, $\alpha$, may be about 19° according to a particular embodiment of rack 100.

Referring to FIGS. 3A and 3B, a plurality of downward angled prongs 184 extending from left 180 and right 182 forward supports are shown. As shown more particularly in FIG. 3B, each downward angled prong 184 may extend at an angle, $\beta$, relative to horizontal surface 156. According to a particular embodiment, angle, $\beta$, may be about 60°. Furthermore, as shown best in FIG. 3B, the plurality of downward angled prongs 184 may be affixed to their respective left 180 and right 182 forward supports at any suitable distance from a horizontal surface 156. According to the particular embodiment illustrated in FIG. 3B, the four downward angled prongs 184 may be located at 6", 7", 9" and 10" from the horizontal surface 156.

FIG. 4A is a left side view of an embodiment of a grocery bag loading rack 100 according to the present invention. FIG. 4B is a detailed view of an embodiment of an upper portion of a left rear pillar 114 of the grocery bag loading rack 100, as indicated in FIG. 4A, of the present invention. It will be understood that the features shown in the left side views of FIGS. 4A and 4B are present in mirror on the right side of rack 100.

More particularly, FIG. 4A illustrates left rear pillar 114, left bottom bar 118, left forward support 180, upper support 420, left upper arm 160, left lower arm 170 and location of the detail shown in FIG. 4B. According to the embodiment shown in FIGS. 4A and 4B, the left rear pillar 114 may be constructed in part from a left main support arm 402 connected to the left upper support 420. From the left side view shown in FIG. 4A and detailed partially in FIG. 4B, the embodiment of a left main support arm 402 may include an inward angled closed loop 404 located vertically between the left upper arm 160 and the left lower arm 170, the closed loop 404 transitioning into a vertical left rear bar 406 extending down to the left bottom bar 118. The left bottom bar 118 extends perpendicularly from the vertical left rear bar 406 and along the bottom side 104 to end in a left front bottom hook 122. Angled closed loop 404 is used to suspend a packet of smaller disposable plastic grocery bags (not shown) on the outside of rack 100. Such smaller plastic grocery bags are useful for bagging small items rather than using a full-size gusseted plastic bag. Note that closed loops 404 are angled inward on rack 100, see for example FIG. 1B. The left upper arm 160 may be supported in the rear by left upper support 420 and towards the front by left forward support 180. Whereas, the left lower arm 170 is only supported by the left upper support 420 and left main support arm 402, both of which are located at the left rear pillar 114.

According to the particular embodiment illustrated in FIG. 4A, the distance from the top of left upper arm 160 to the horizontal surface 156 at bottom side 104 is about 15.8". According to the particular embodiment illustrated in FIG. 4A, the distance from the bottom of the of left upper arm 160 to the horizontal surface 156 at bottom side 104 is about 14.5". According to the particular embodiment illustrated in FIG. 4A, the distance from the top of left lower arm 170 to the horizontal surface 156 at bottom side 104 is about 11.8". These dimensions were determined by the inventor to best accommodate standard disposable plastic gusseted t-shirt grocery bags and most all reusable grocery bags.

The embodiment of a left forward support 180 may be connected to the left upper arm 160 and the left bottom bar 118 of the first or left main support arm 402. Note however, that left forward support 180 is intentionally not connected to the left lower arm 170 and, in fact, incorporates an outward bend to avoid contact with the left lower arm 170. As shown best in FIG. 4B, both left upper arm 160 and left lower arm 170 extend perpendicularly from the left rear pillar 114. It will be understood by one of ordinary skill in the art and from the symmetry of the rack 100 that a mirror image right side 106 may be configured with identically the mirror-image features shown in FIGS. 4A and 4B. Accordingly, such details from the right side 106 will not be further detailed herein.

Figure 5B:
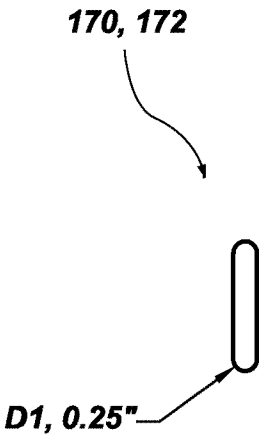
FIGS. 5A and 5B illustrate side and front views, respectively, of an embodiment of a left or right lower arm, according to the present invention.
Figure 5A:
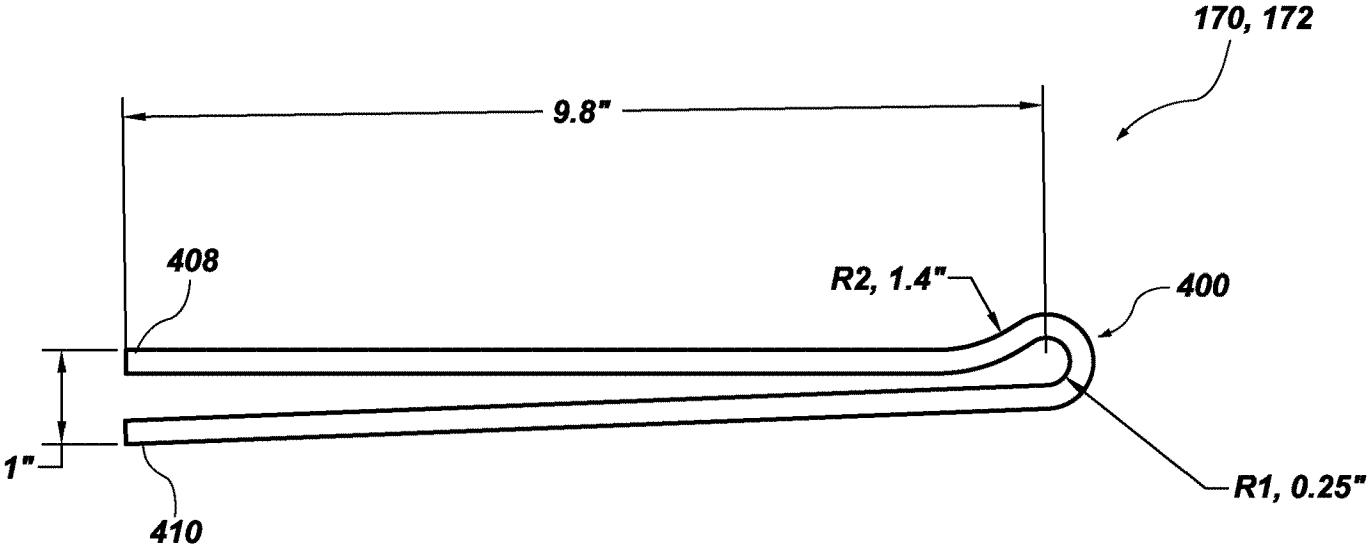

FIGS. 5A and 5B illustrate side and front views, respectively, of an embodiment of a left 170 or right 172 lower arm, according to the present invention. According to the illustrated embodiment, overall length may be about 10" formed from a a metal rod having diameter of approximately 0.25", with two ends (upper 408 and lower 410) configured for attachment to left 114 and right 116 rear pillars. Each embodiment of a left 170 or right 172 lower arm may further be configured with a bend 400 located opposite the ends 408 and 410. The bend 400 may be configured with an inside radius, R1, measured from within the bend 400, having particular dimensions of about 0.25", according to the illustrated embodiment. The upper portion of bend 400 may further include an outside radius, R2, measured from outside the bend 400, having particular dimensions of about 1.4", according to the illustrated embodiment. The outside radius, R2, forms a stop for catching an extended standard plastic disposable grocery bag during loading. It will be understood that the general shape and configuration of the left 160 and the right 162 upper arms are generally of the same shape and configuration of the left 170 and right 172 lower arms, but with larger dimensions and, of course, the additional vertical prongs 164.

Figure 6A:
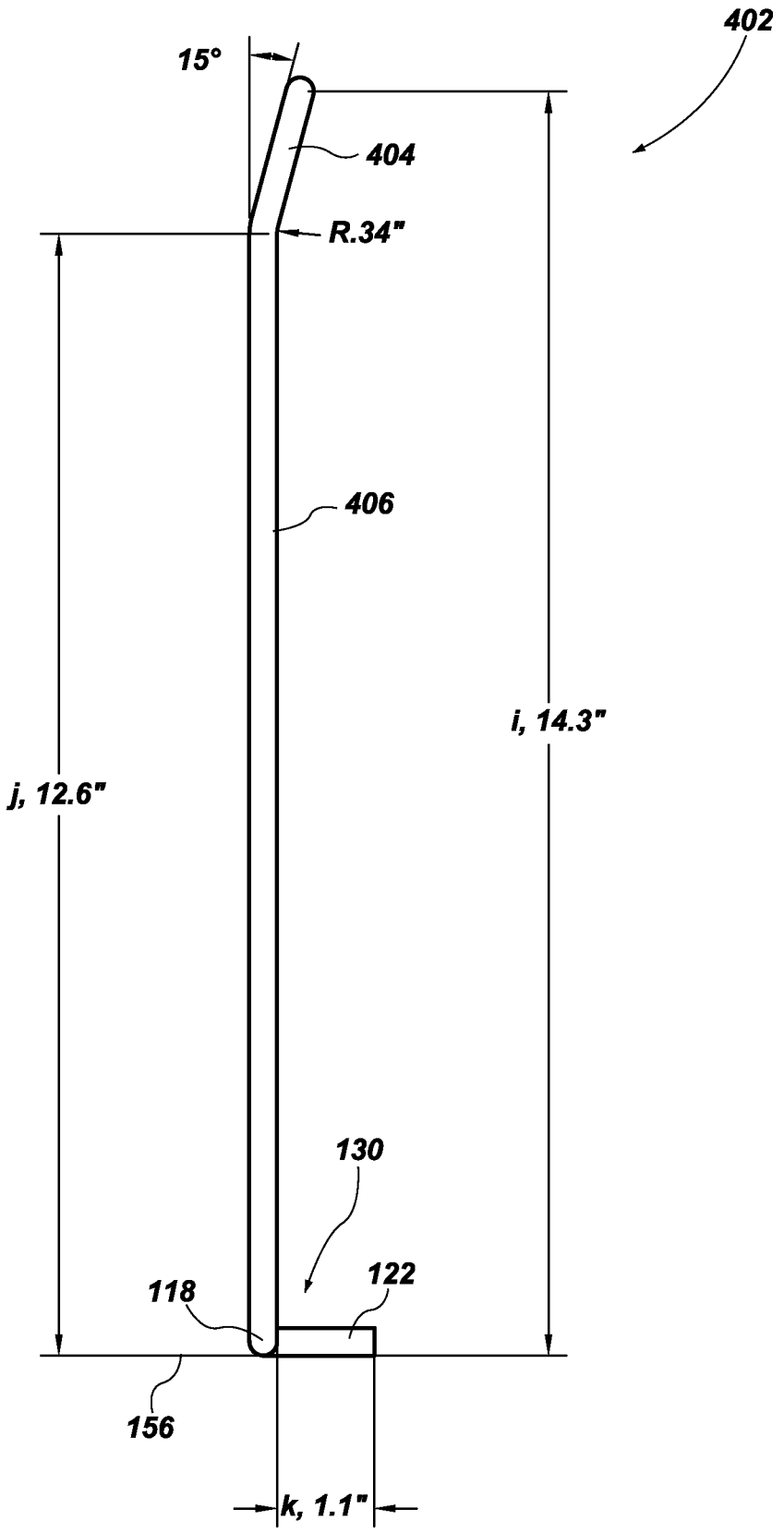
FIGS. 6A and 6B illustrate front and left side views, respectively, of an embodiment of a left main support arm of an embodiment of a grocery bag loading rack, according to the present invention.
Figure 6B:
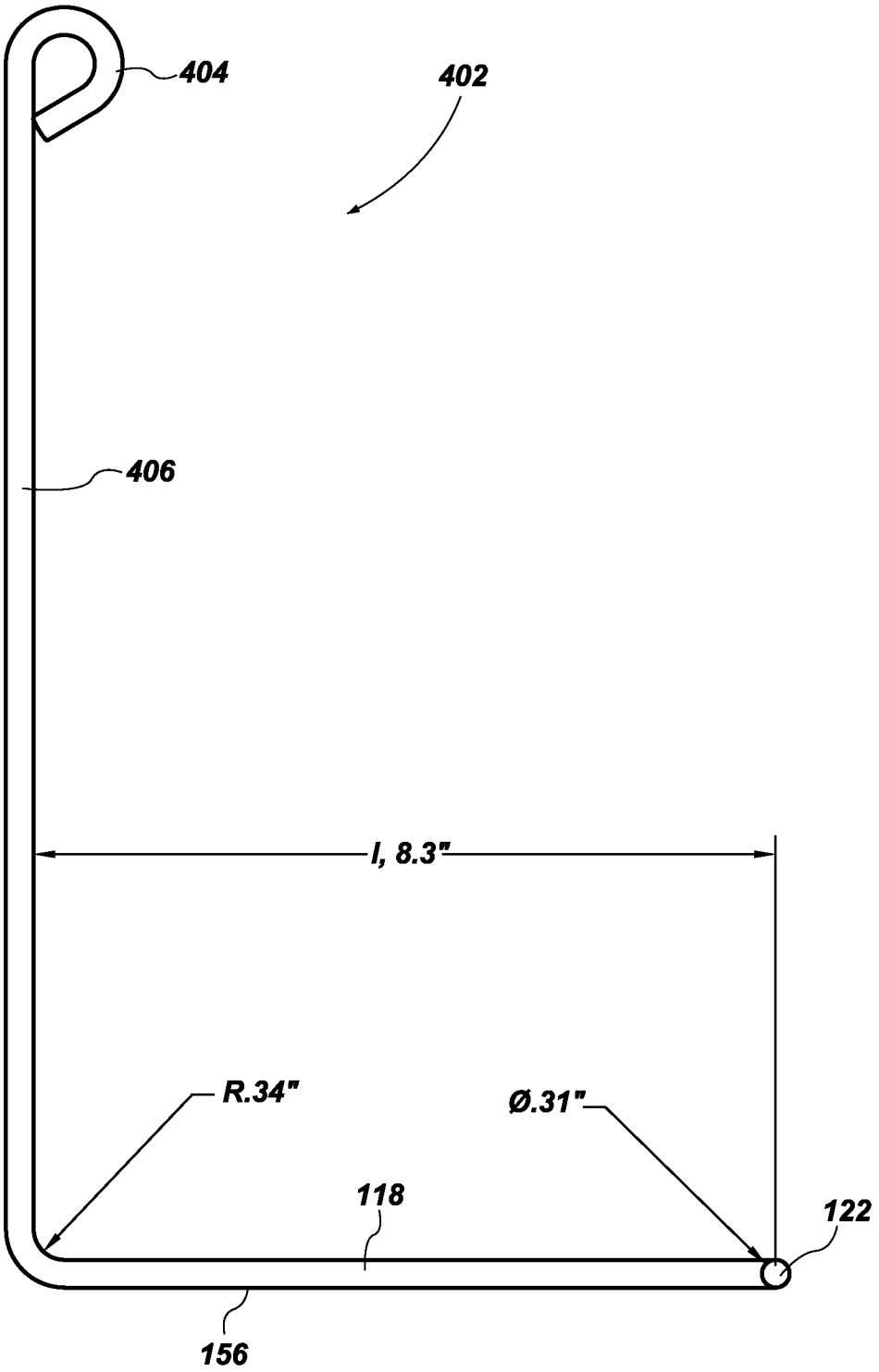

FIGS. 6A and 6B illustrate front and left side views, respectively, of an embodiment of a left main support arm 402 of an embodiment of a grocery bag loading rack 100, according to the present invention. According to the illustrated embodiment, left main support arm 402 may include an inward angled closed loop 404 located at a top end, which transitions to a vertically oriented left rear bar 406 extending downward toward horizontal surface 156 into left bottom bar 118, which in turn extends perpendicularly toward the front side of rack 100 and finally transitions into left front bottom hook 122, which extends perpendicularly toward the right side 106 (see FIG. 1B) to form left front foot 130.

FIGS. 6A and 6B further illustrate various dimensions of the left main support arm 402. Referring FIG. 6A, the overall height, i, of left main support arm 402 may be about 14.3", according to a particular embodiment of a left main support arm 402. The length, j, from the bottom of inward angled closed loop 404 down to the horizontal surface 156 may be about 12.6", according to a particular embodiment of a left main support arm 402. The length, k, of the left front bottom hook 122 may be about 1.1" according to a particular embodiment of a left main support arm 402. Referring now to FIG. 6B, the length, l, of the left bottom bar 118 may be about 8.3" according to a particular embodiment of a left main support arm 402. Again because of symmetry it will be understood that right main support arm 430 (FIGS. 7A and 7B, as further discussed below) may be configured with similar dimensions and in mirror configuration to the left main support arm 402.

Figure 7A:
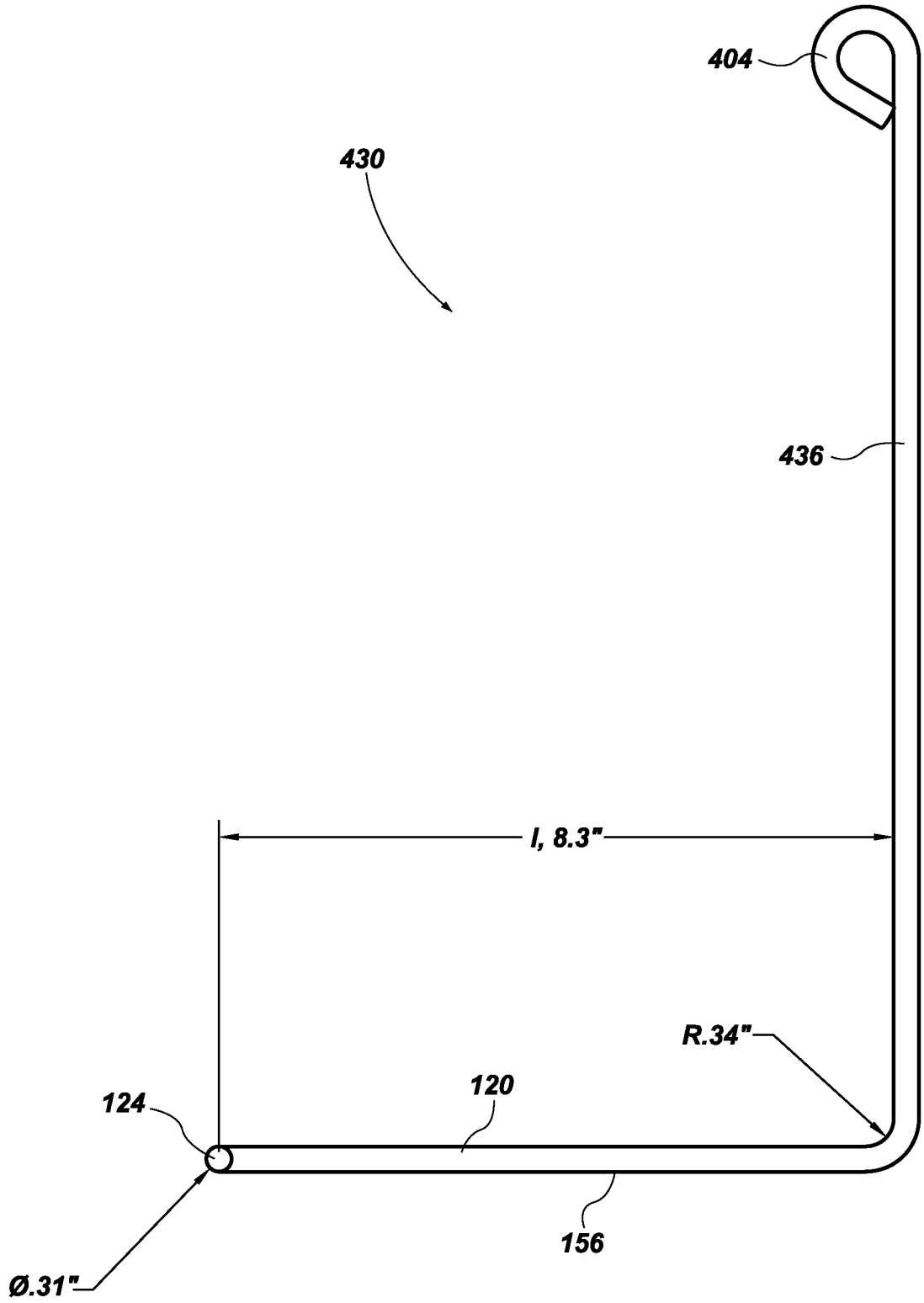
FIGS. 7A and 7B illustrate right side and front views, respectively, of an embodiment of a right main support arm of an embodiment of a grocery bag loading rack, according to the present invention.
Figure 7B:
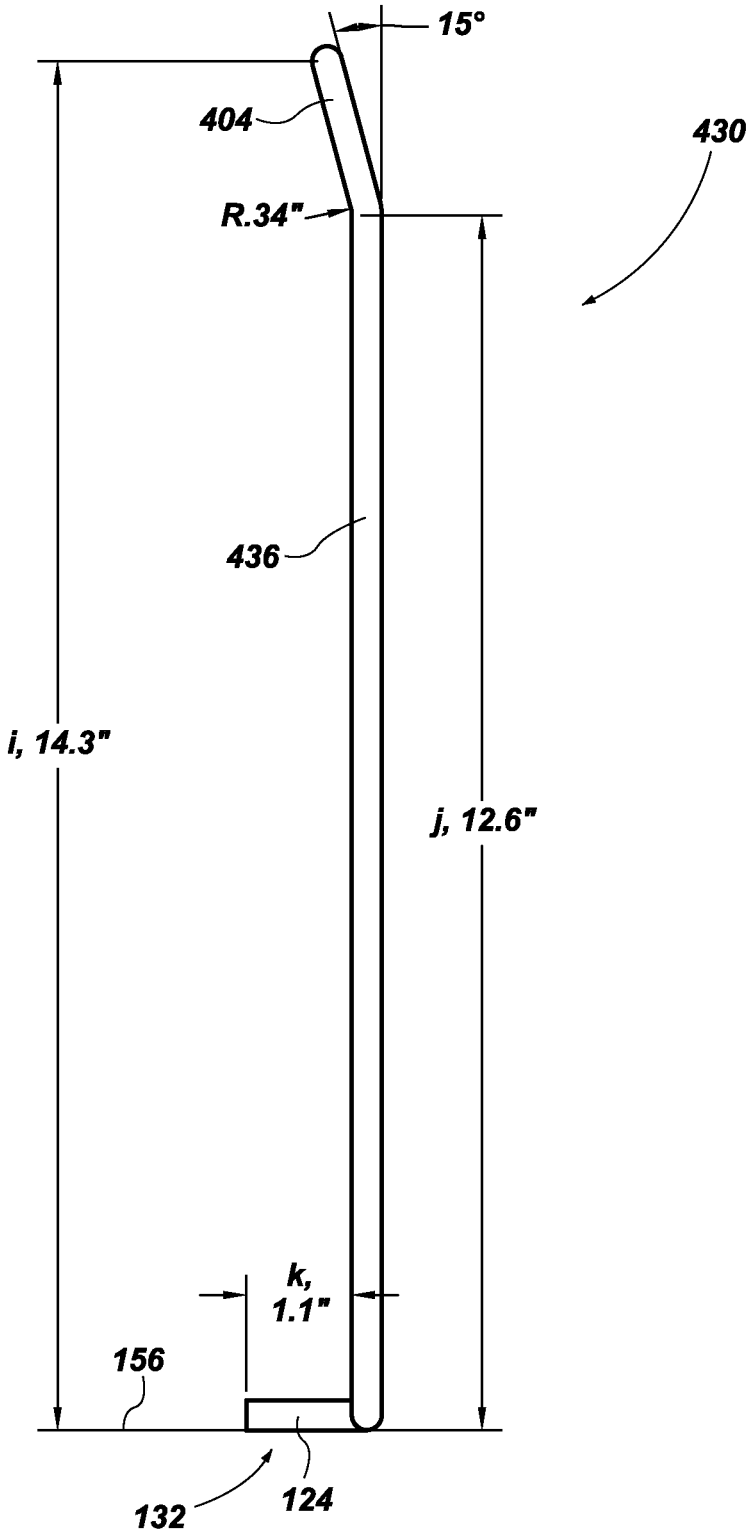

FIGS. 7A and 7B illustrate right side and front views, respectively, of an embodiment of a right main support arm 430 of an embodiment of a grocery bag loading rack 100, according to the present invention. According to the illustrated embodiment, right main support arm 430 may include a left inward angled closed loop 404 located at a top end, which transitions to a vertically oriented right rear bar 436 extending downward toward horizontal surface 156 into right bottom bar 120, which in turn extends perpendicularly toward the front side of rack 100 and finally transitions into right front bottom hook 124, which extends perpendicularly toward the left side 108 (see FIG. 1B) to form right front foot 132.

FIGS. 7A and 7B further illustrate various dimensions of the right main support arm 430. Referring FIG. 7B, the overall height, i, of right main support arm 430 may be about 14.3", according to a particular embodiment of a right main support arm 430. The length, j, from the bottom of inward angled closed loop 404 down to the horizontal surface 156 may be about 12.6", according to a particular embodiment of a right main support arm 430. The length, k, of the right front bottom hook 124 may be about 1.1" according to a particular embodiment of a right main support arm 430. Referring now to FIG. 7A, the length, l, of the right bottom bar 120 may be about 8.3" according to a particular embodiment of a right main support arm 430.

Figure 8:
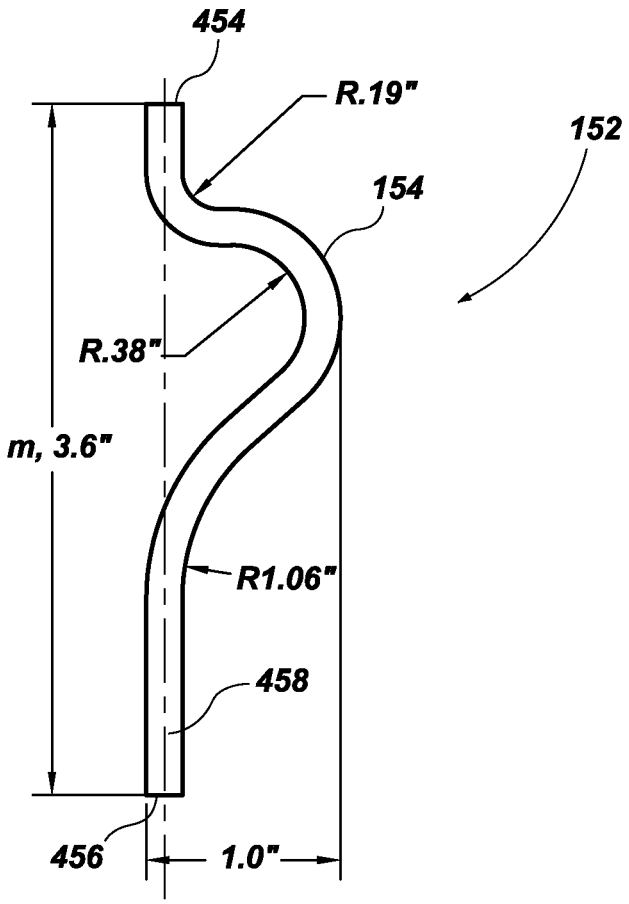
FIG. 8 illustrates a side view of a spine loop, according to the present invention.

FIG. 8 illustrates a side view of a spine loop 152, according to the present invention. Spine loop 152 may be formed of a metal rod having a suitable diameter or gauge. Spine loop 152 may include a top end 454 configured for mounting to the first intermediate support bar 144 and a bottom end 456 configured for mounting to third intermediate support bar 148, with both top 454 and bottom 456 ends tracking a vertical axis 458 that runs parallel to the vertical rear side 110 of the rack. Spine loop 152 may further include, a bend, or loop portion 154 located closer to the top end 454 than the bottom end 456. Dimensions of spine loop 152 may be as shown in FIG. 8, according to a particular embodiment. More generally, spine loop 152 may have a length, m and bend 460 may have in inside radius, R3. Inside radius, R3, may be about 0.38" according to a particular embodiment.

Figure 9:
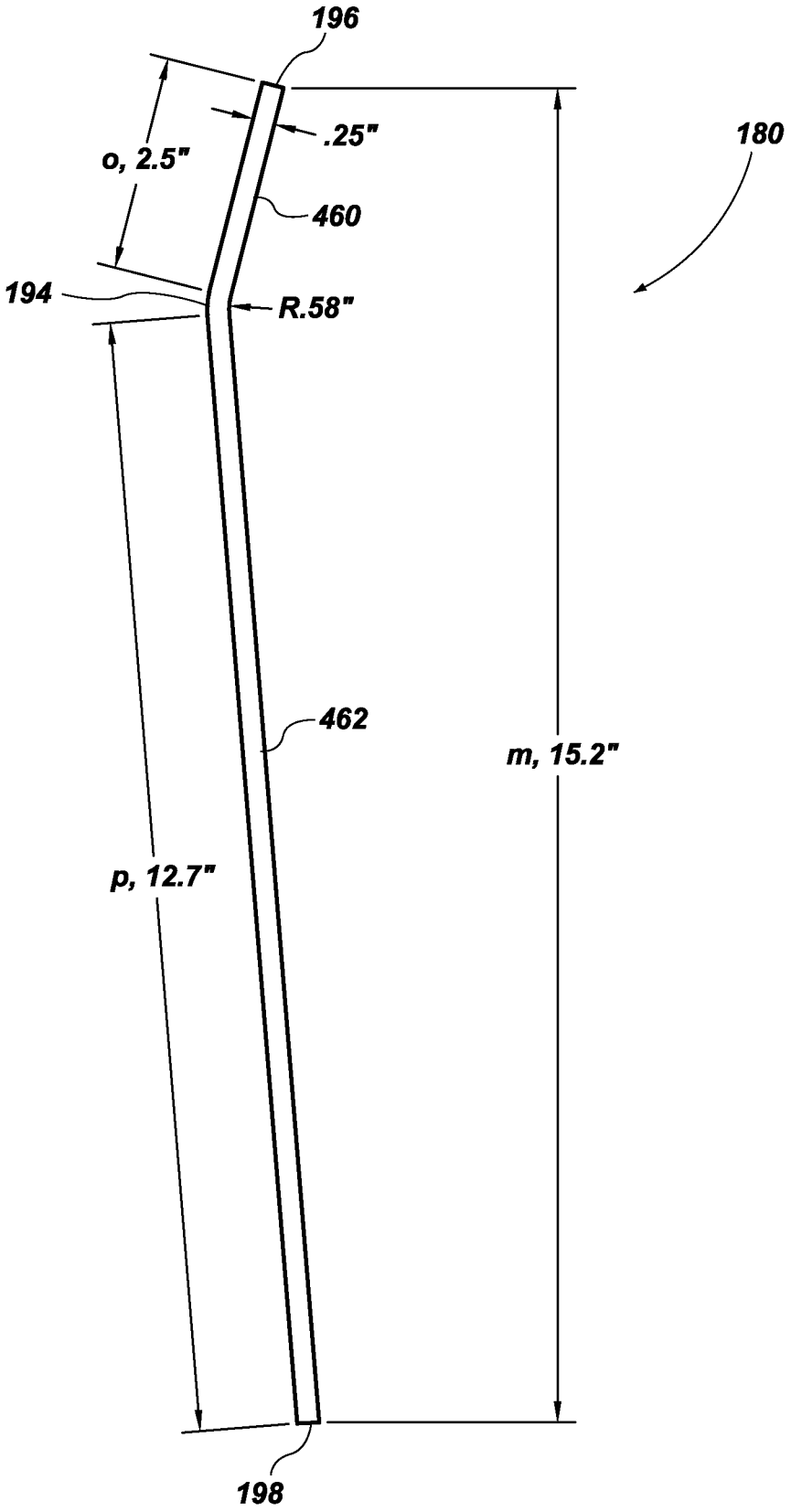
FIG. 9 illustrates a front view of a left forward support, according to the present invention.

FIG. 9 illustrates a front view of a left forward support 180, according to the present invention. It will be understood that the right forward support 182 is a mirror image of the left forward support 180. Overall length, n, of left forward support may be about 15.2", according to a particular embodiment. Left forward support 180 may include a bend point 194 located closer to the top end 196 than the bottom end 198. As noted herein the bend in the forward supports 180 and 182 allows clearance around the lower support arms 170 and 172, respectively. This allows the looped plastic disposable gusseted grocery bags to freely slide on and off the lower support arms 170 and 172, during installation, loading and removal. The distance, o, between the top end 196 and bend point 194 of the upper linear portion 460 may be approximately, 2.5", according to a particular embodiment of rack 100. The distance, p, between the bottom end 198 and bend point 194 of the lower linear portion 462 may be approximately, 12.7", according to a particular embodiment of rack 100.

Having described a particular embodiment of grocery bag loading rack 100, the use of same will now be described using reusable grocery bags and also plastic disposable gusseted grocery bags. As one of ordinary skill in the art is aware, a packet of plastic disposable gusseted grocery bags come with two side loop holes and a center loop hole passing through each of the stacked plastic bags. Using an embodiment of a rack 100, a packet of plastic disposable gusseted grocery bags may be installed by placing each of two side loop holes onto the lower arms 170, 172 of rack 100, followed by placing the center loop hole over the standard bag hook 150. Then a user need only press down on the front bag in the packet applying pressure against the spine loop and thus separating the front end of the front bag from its back end and sliding it forward along each of the lower arms 170, 172 of rack 100 to open up the bag for loading. Groceries may then be inserted into the bag until sufficient capacity is reached. Then the loaded bag may be removed from the rack 100 by sliding the bag off the front (looped) end of each of the lower arms 170, 172 of rack 100 to be carried out or loaded back into a shopping cart for transportation to the customer's vehicle.

The method of using of rack 100 with a reusable grocery bag is different and employs different features of the rack 100. First a user places the reusable grocery bag within the loading void 112, with each of its two looped handles above the rack 100, then the looped handles are wrapped around one or more of the vertical prongs 164 disposed about the top of the upper arms 160, 162 of the rack 100 to spread open the reusable grocery bag. If the vertical prongs 164 do not take up sufficient slack from the two looped handles, they looped handles can each be hooked over one of the plurality of downward angled prongs 184 located along the forward supports 180, 182. In this way the reusable grocery bag may be held securely in an open position for two handed loading of groceries in much the same way as with the disposable plastic bags. Once capacity is reached, the looped handles may be unhooked from the downward angled prongs 184 and up and over the vertical prongs 164 and removed from within the rack by sliding out the open front of rack 100 to be carried out or loaded back into a shopping cart for transportation to the customer's vehicle.

Having described a particular embodiment of a rack 100 and its methods of use, some general embodiments of a grocery bag loading rack will now be described. For example, a grocery bag loading rack is disclosed. The rack may include a cuboid-shaped frame having a bottom, right, left and rear sides. The frame may be, for example and not by way of limitation, the embodiment of a frame 102 shown in FIGS. 1A and 1B. The frame may be configured for supporting a grocery bag in open position to form a loading void, within the grocery bag that is also within the frame. According to one particular embodiment, the frame may be open at top and front sides. According to this embodiment, the rear side may further include a left rear pillar defining a boundary between the left and rear sides, and a right rear pillar defining a boundary between the right and rear sides. According to one particular embodiment, the left rear pillar may be configured as the left rear pillar shown in FIGS. 1A and 1B. According to this general embodiment, the left side may further include a left bottom bar extending from the left rear pillar that defines a boundary between the left and bottom sides of the frame. According to this embodiment, the right side mirrors the left side and further includes a right bottom bar extending from the right rear pillar that defines a boundary between the right and bottom sides. According to this embodiment, the bottom side may further include a left front bottom hook extending from left bottom bar in a direction toward the right side. According to this embodiment, the bottom side may further include a right front bottom hook extending from the right bottom bar in a direction toward the left side. According to this embodiment, the bottom side may further include a left rear bottom hook extending from the left rear pillar down toward a plane passing through the bottom side and in a direction toward the front side. According to this embodiment, the bottom side may further include a right rear bottom hook extending from the right rear pillar down toward the plane through the bottom side and in a direction toward the front side.

Another embodiment of a grocery bag loading rack may further include a rectangular-shaped base having a top surface, a bottom surface, rear edge, front edge, left edge, right edge and a thickness, t, separating the top surface from the bottom surface and thereby giving the edges depth. According to this embodiment of a rack, the base may further be configured with two holes entering the rear edge, one each for receiving the right front bottom hook and the left rear bottom hook. According to this embodiment, the base may further be configured with a hole entering the left edge configured for receiving the left front bottom hook. According to this embodiment, the base may further be configured with a hole entering the right edge configured for receiving the right rear bottom hook. According to this embodiment, the holes of the base may be used to secure the left, the right and the rear sides of the base to the bottom side of the frame via the hooks. According to a particular embodiment, the base may be formed of a hard plastic material.

According to another embodiment of a grocery bag loading rack, the rear side of the frame further include an upper support bar connected between the left rear pillar and the right rear pillar at the top side of the frame. The rear side of the frame may further include a first intermediate support bar connected between the left rear pillar and the right rear pillar and parallel to, and below, the upper support bar. The rear side of the frame may further include a second intermediate support bar connected between the left rear pillar and the right rear pillar and parallel to, and below, the first intermediate support bar. The rear side of the frame may further include a third intermediate support bar connected between the left rear pillar and the right rear pillar and parallel to, and below, the second intermediate support bar. The rear side of the frame may further include a lower support bar connected between the left rear pillar and the right rear pillar and parallel to, and below, the third intermediate support bar.

According to another embodiment of a grocery bag loading rack, the left side of the frame may further include a left upper arm extending from the left rear pillar in a direction from the rear side toward the front side along the top side of the rack. This embodiment of the left side of the frame may further include a left lower arm extending from the left rear pillar in a direction from the rear side toward the front side and below the left upper arm. This embodiment of the left side of the frame may further include a left forward support connected to the left upper arm and the left bottom bar, including upper and lower linear portions separated by a left bend point forming a left outward bend away from, and not connected to, the left lower arm.

According to yet another embodiment of a grocery bag loading rack, the left forward support may further include a plurality of downward angled prongs, each downward angled prong located at a different location along the left forward support and configured to hook a looped handle of reusable grocery bag into an open position on the left side for loading of the bag. According to still another embodiment of a grocery bag loading rack, the left bend point may be located closer to the top of the rack than the bottom of the rack and all of the downward angled prongs may be disposed along the lower linear portion below the left bend point.

According to still yet another embodiment of a grocery bag loading rack, the left upper arm may further include a plurality of vertical prongs disposed along the left upper arm. According to this particular embodiment, each vertical prong may extend vertically upward from the left upper arm and be configured to receive and stretch a looped handle of a reusable grocery bag into an open position on the left side for loading of the bag.

According to one embodiment of a grocery bag loading rack, the right side of the frame may further include a right upper arm extending from the right rear pillar in a direction from the rear side toward the front side along the top side of the rack. According to this particular embodiment, the right side of the frame may further include a right lower arm extending from the right rear pillar in a direction from the rear side toward the front side and below the right upper arm. According to this particular embodiment, the right side of the frame may further include a right forward support connected to the right upper arm and the right bottom bar, including upper and lower linear portions separated by a right bend point forming a right outward bend away from and not connected to the right lower arm.

According to another embodiment of a grocery bag loading rack, the right forward support may further include a plurality of downward angled prongs, each downward angled prong located at a different location along the right forward support and configured to hook a looped handle of reusable grocery bag into an open position on the right side for loading of the bag. According to yet another embodiment of a grocery bag loading rack, the right bend point may be located closer to the top of the rack than the bottom of the rack and all of the downward angled prongs may be disposed along the lower linear portion below the right bend point.

According to still another embodiment of a grocery bag loading rack, the right upper arm may further include a plurality of vertical prongs disposed along the right upper arm. According to this particular embodiment, each vertical prong may extend vertically upward from the right upper arm and may be configured to receive and stretch a looped handle of reusable grocery bag into an open position on the right side for loading of the bag.

According to another embodiment, the grocery bag loading rack may further include a standard bag hook configured as an inverted U shape with ends attached to the first intermediate support bar, the bag hook extending vertically toward the upper support bar and may be configured to receive a central opening of a packet of plastic disposable grocery bags. According to another embodiment, the grocery bag loading rack may further include a spine loop extending perpendicularly across, and connected to, the first, the second and the third intermediate support bars with a bend or loop portion of the spine loop extending toward the front of the rack and away from the back of the rack. According to this particular embodiment, a vertical axis of the spine loop may be oriented parallel to the left and rear pillars. The spine loop may be configured to According to another embodiment of a grocery bag loading rack, the left rear pillar, the left bottom bar and the left front bottom hook comprise a left main support arm. According to this particular embodiment, the left main support arm may be formed of a single rod of metal. The rod of metal may include a left inward angled closed loop at a top end, a vertical left rear bar extending vertically down from the closed loop and the left bottom bar extending from the vertical left rear bar at the bottom towards the front and ending in the left front bottom hook. According to yet another embodiment of a grocery bag loading rack, the right rear pillar, the right bottom bar and the right front bottom hook comprise a right main support arm formed of a single rod of metal that is a mirror image of the left main support arm.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. It will be understood that the terms "bottom," "right," "left," "top," "rear" and "front" with respect to the embodiments of a grocery bag rack 100 disclosed herein are relative to the embodiments of a grocery bag rack 100 with open front side directly opposite, and placed in front, of the user. As used herein to describe the present invention, the following directional terms "forward, rearward, above, downward, vertical, horizontal, below and transverse" as well as any other similar directional terms refer to those directions relative to any embodiment of a grocery bag loading rack 100 placed with bottom side on a horizontal surface with open front side placed opposite, and in front, of a user according to the present invention. Finally, terms of degree such as "substantially", "about" and "approximately" as used herein mean a reasonable amount of deviation of the modified term such that the end result is not significantly changed.

It will further be understood that the present invention may suitably comprise, consist of, or consist essentially of the component parts, method steps and limitations disclosed herein. However, the invention illustratively disclosed herein suitably may be practiced in the absence of any element which is not specifically disclosed herein.

While the foregoing advantages of the present invention are manifested in the detailed description and illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A grocery bag loading rack, comprising:

a cuboid-shaped frame having a bottom, right, left and rear sides, the frame configured for supporting a grocery bag in open position to form a loading void, within the grocery bag that is also within the frame, the frame open at top and front sides;

wherein the rear side further comprises a left rear pillar defining a boundary between the left and rear sides, and a right rear pillar defining a boundary between the right and rear sides;

wherein the left side further comprises a left bottom bar extending from the left rear pillar and defining a boundary between the left and bottom sides, a left upper arm extending from the left rear pillar in a direction from the rear side toward the front side along the top side of the rack;

a left lower arm extending from the left rear pillar in a direction from the rear side toward the front side and below the left upper arm; and a left forward support connected to the left upper arm and the left bottom bar, including upper and lower linear portions separated by a left bend point forming a left outward bend away from and not connected to the left lower arm;

wherein the right side mirrors the left side and further comprises a right bottom bar extending from the right rear pillar and defines a boundary between the right and bottom sides; and wherein the bottom side further comprises:

a left front bottom hook extending from left bottom bar in a direction toward the right side;

a right front bottom hook extending from the right bottom bar in a direction toward the left side;

a left rear bottom hook extending from the left rear pillar down toward a plane passing through the bottom side and in a direction toward the front side; and a right rear bottom hook extending from the right rear pillar down toward the plane through the bottom side and in a direction toward the front side.

2. The grocery bag loading rack according to claim 1, further comprising a rectangular-shaped base having a top surface, a bottom surface, rear edge, front edge, left edge, right edge and a thickness, t, separating the top surface from the bottom surface and thereby giving the edges depth, the base further configured with two holes entering the rear edge, one each for receiving the right front bottom hook and the left rear bottom hook, the base further configured with a hole entering the left edge configured for receiving the left front bottom hook, the base further configured with a hole entering the right edge configured for receiving the right rear bottom hook, thereby securing the left, the right and the rear sides of the base to the bottom side of the frame.

3. The grocery bag loading rack according to claim 2, wherein the base comprises a hard plastic material.

4. The grocery bag loading rack according to claim 1, wherein the rear side of the frame further comprises:

an upper support bar connected between the left rear pillar and the right rear pillar at the top side of the frame;

a first intermediate support bar connected between the left rear pillar and the right rear pillar and parallel to, and below, the upper support bar;

a second intermediate support bar connected between the left rear pillar and the right rear pillar and parallel to, and below, the first intermediate support bar;

a third intermediate support bar connected between the left rear pillar and the right rear pillar and parallel to, and below, the second intermediate support bar; and a lower support bar connected between the left rear pillar and the right rear pillar and parallel to, and below, the third intermediate support bar.

5. The grocery bag loading rack according to claim 1, wherein the left forward support further comprises a plurality of downward angled prongs, each downward angled prong located at a different location along the left forward support and configured to hook a looped handle of reusable grocery bag into an open position on the left side for loading of the bag.

6. The grocery bag loading rack according to claim 5, wherein the left bend point is located closer to the top of the rack than the bottom of the rack and all of the downward angled prongs are disposed along the lower linear portion below the left bend point.

7. The grocery bag loading rack according to claim 1, wherein the left upper arm further comprises a plurality of vertical prongs disposed along the left upper arm, each vertical prong extending vertically upward from the left upper arm and configured to receive and stretch a looped handle of a reusable grocery bag into an open position on the left side for loading of the bag.

8. A grocery bag loading rack, comprising:

a cuboid-shaped frame having a bottom, right, left and rear sides, the frame configured for supporting a grocery bag in open position to form a loading void, within the grocery bag that is also within the frame, the frame open at top and front sides;

wherein the rear side further comprises a left rear pillar defining a boundary between the left and rear sides, and a right rear pillar defining a boundary between the right and rear sides;

wherein the left side further comprises a left bottom bar extending from the left rear pillar and defines a boundary between the left and bottom sides;

wherein the right side mirrors the left side and further comprises:

a right bottom bar extending from the right rear pillar and defining a boundary between the right and bottom sides; and wherein the bottom side further comprises:

a left front bottom hook extending from left bottom bar in a direction toward the right side;

a right front bottom hook extending from the right bottom bar in a direction toward the left side;

a left rear bottom hook extending from the left rear pillar down toward a plane passing through the bottom side and in a direction toward the front side; and a right rear bottom hook extending from the right rear pillar down toward the plane through the bottom side and in a direction toward the front side; and wherein the right side of the frame further comprises:

a right upper arm extending from the right rear pillar in a direction from the rear side toward the front side along the top side of the rack;

a right lower arm extending from the right rear pillar in a direction from the rear side toward the front side and below the right upper arm; and a right forward support connected to the right upper arm and the right bottom bar, including upper and lower linear portions separated by a right bend point forming a right outward bend away from and not connected to the right lower arm.

9. The grocery bag loading rack according to claim 8, wherein the right forward support further comprises a plurality of downward angled prongs, each downward angled prong located at a different location along the right forward support and configured to hook a looped handle of reusable grocery bag into an open position on the right side for loading of the bag.

10. The grocery bag loading rack according to claim 9, wherein the right bend point is located closer to the top of the rack than the bottom of the rack and all of the downward angled prongs are disposed along the lower linear portion below the right bend point.

11. The grocery bag loading rack according to claim 8, wherein the right upper arm further comprises a plurality of vertical prongs disposed along the right upper arm, each vertical prong extending vertically upward from the right upper arm and configured to receive and stretch a looped handle of reusable grocery bag into an open position on the right side for loading of the bag.

12. The grocery bag loading rack according to claim 4, further comprising a standard bag hook configured as an inverted U shape with ends attached to the first intermediate support bar, the hook extending vertically toward the upper support bar and configured to receive a central opening of a packet of plastic disposable grocery bags.

13. The grocery bag loading rack according to claim 10, further comprising a spine loop extending perpendicularly across, and connected to, the first, the second and the third intermediate support bars with a loop portion of the spine loop extending toward the front of the rack, a vertical axis of the spine loop oriented parallel to the left and rear pillars, the spine loop configured to facilitate opening of individual plastic disposable grocery bags prior to loading.

14. The grocery bag loading rack according to claim 1, wherein the left rear pillar, the left bottom bar and the left front bottom hook comprise a left main support arm, the left main support arm formed of a single rod of metal.

15. The grocery bag loading rack according to claim 14, wherein the right rear pillar, the right bottom bar and the right front bottom hook comprises a right main support arm formed of a single rod of metal.

* * * * *